US006370723B1

(12) United States Patent
Chang

(10) Patent No.: US 6,370,723 B1
(45) Date of Patent: Apr. 16, 2002

(54) MULTIFUNCTIONAL BATHING TOOL

(76) Inventor: Che-Yuan Chang, No. 1, Lane 147, Sec. 2, Chung San Rd., Yun Lin, Chang Hua Hsien (TW)

( * ) Notice: Subject to any disclaimer, the term of this patent is extended or adjusted under 35 U.S.C. 154(b) by 8 days.

(21) Appl. No.: 09/669,628

(22) Filed: Sep. 26, 2000

(51) Int. Cl.[7] ..... A47K 7/02; A47K 7/04

(52) U.S. Cl. ..... 15/110; 15/229.13; 15/176.4; 15/176.3

(58) Field of Search ..... 15/106, 107, 110, 15/111, 114, 176.4, 176.5, 176.6, 176.1, 176.2, 209.1, 223, 224, 229.13, 176.3

(56) References Cited

U.S. PATENT DOCUMENTS 926,303 A * 6/1909 Thompson
1,146,646 A * 7/1915 Morgan
1,153,409 A * 9/1915 Wheeler
3,060,478 A * 10/1962 Silver
4,486,109 A * 12/1984 Rosofsky
5,960,509 A * 10/1999 Wu
6,098,233 A * 8/2000 Chen
6,276,022 B1 * 8/2001 Gallacher

* cited by examiner

*Primary Examiner*—Terrence R. Till
(74) *Attorney, Agent, or Firm*—Browdy and Neimark, P.L.L.C.

(57) ABSTRACT

A multifunctional bathing tool includes a handle and at least one cleaning brush unit. The handle has one end provided with at least one engaging portion for removably securing a securing seat of the cleaning brush unit on the engaging portion. The handle further has a plurality of massaging bosses provided on the side opposite to the cleaning brush unit. The user can hold the handle to clean the body with the cleaning brush, and use the massaging bosses to massage the body. The cleaning brush unit is detachable from the handle so that the user can directly hold the securing seat to clean the body with the cleaning brush.

17 Claims, 7 Drawing Sheets

MULTIFUNCTIONAL BATHING TOOL

BACKGROUND OF THE INVENTION (a) Field of the Invention

The present invention relates to a bathing tool, more particularly to a multifunctional bathing tool.

(b) Description of the Prior Art

A conventional bathing brush with handle includes a handle, an annular connecting portion provided at a front end of the handle, and a bathing ball disposed in the connecting portion. In order to secure bathing ball to the handle, the bathing ball is generally fastened to a transverse rod of an annular member at the rear end of the handle.

There is another cleaning brush with handle that includes pawls at the rear end of the handle. The rear end of the pawls is provided with a round ball. A bathing ball is disposed in the pawls or a slot for cleaning and massaging the body. Although such a cleaning brush has body cleaning and massaging functions, since the bathing ball is merely disposed between the pawls, it can easily slip during use, which is inconvenient.

Furthermore, as consumers tend to demand multifunctional articles, cleaning brushes with a single function can no longer satisfy consumers.

SUMMARY OF THE INVENTION

The main object of the present invention is to provide a multifunctional bathing tool, which includes a bathing ball firmly coupled with a handle and can be easily detached therefrom for independent use, and which have multiple functions, such as massaging, magnifying, scrubbing, etc.

In order to achieve the above-mentioned object, the multifunctional bathing tool of the present invention includes a handle and at least a cleaning brush unit. The handle has a rod member, at least one engaging portion provided at one end of the rod member, and a plurality of massaging bosses provided on the rod member in a position opposite to the engaging portion. The cleaning brush unit includes a securing seat and a cleaning brush provided on the securing seat. The securing seat has a retaining portion for detachable engagement with the engaging portion so as to be coupled to the rod member. The cleaning brush and the massaging bosses are located on different sides of the rod member. In use, the user can hold the handle to clean his/her body with the cleaning brush, and use the massaging bosses to massage the body. The cleaning brush unit is detachable from the handle so that the user can hold the securing seat directly to clean the body.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
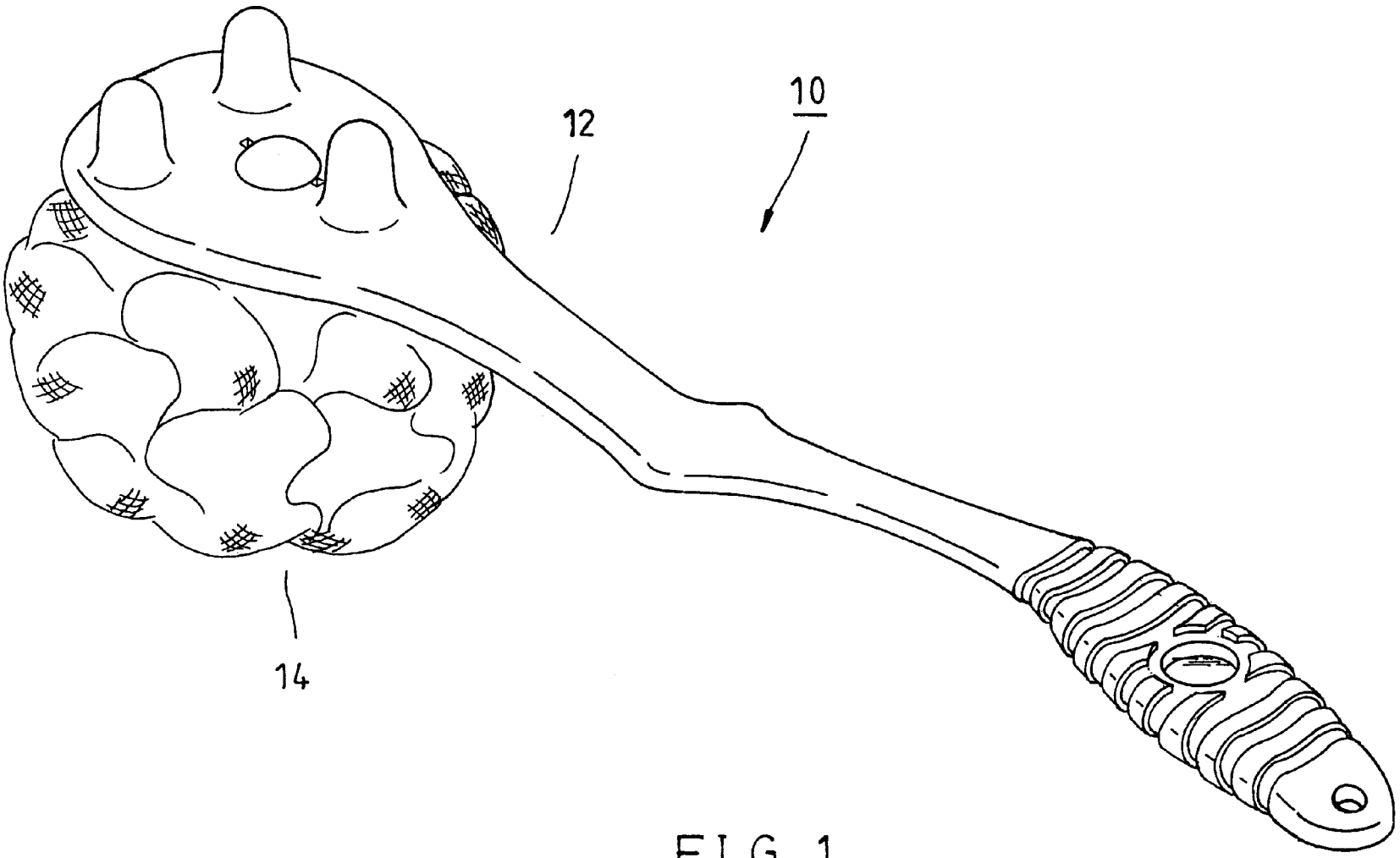
FIG. 1 is an assembled perspective view of a preferred embodiment of the present invention.
Figure 2:
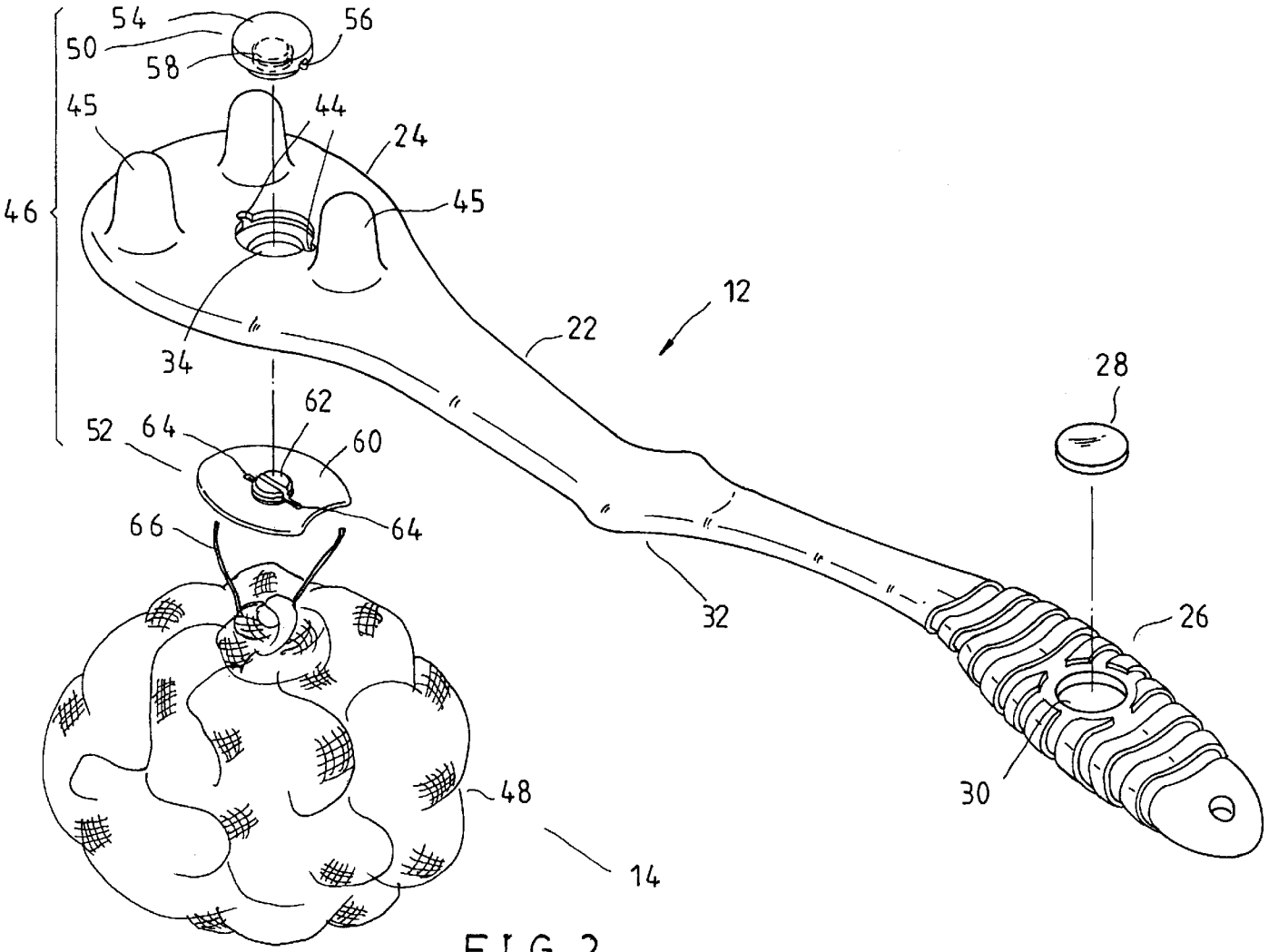
FIG. 2 is an exploded perspective view of the preferred embodiment.
Figure 3:
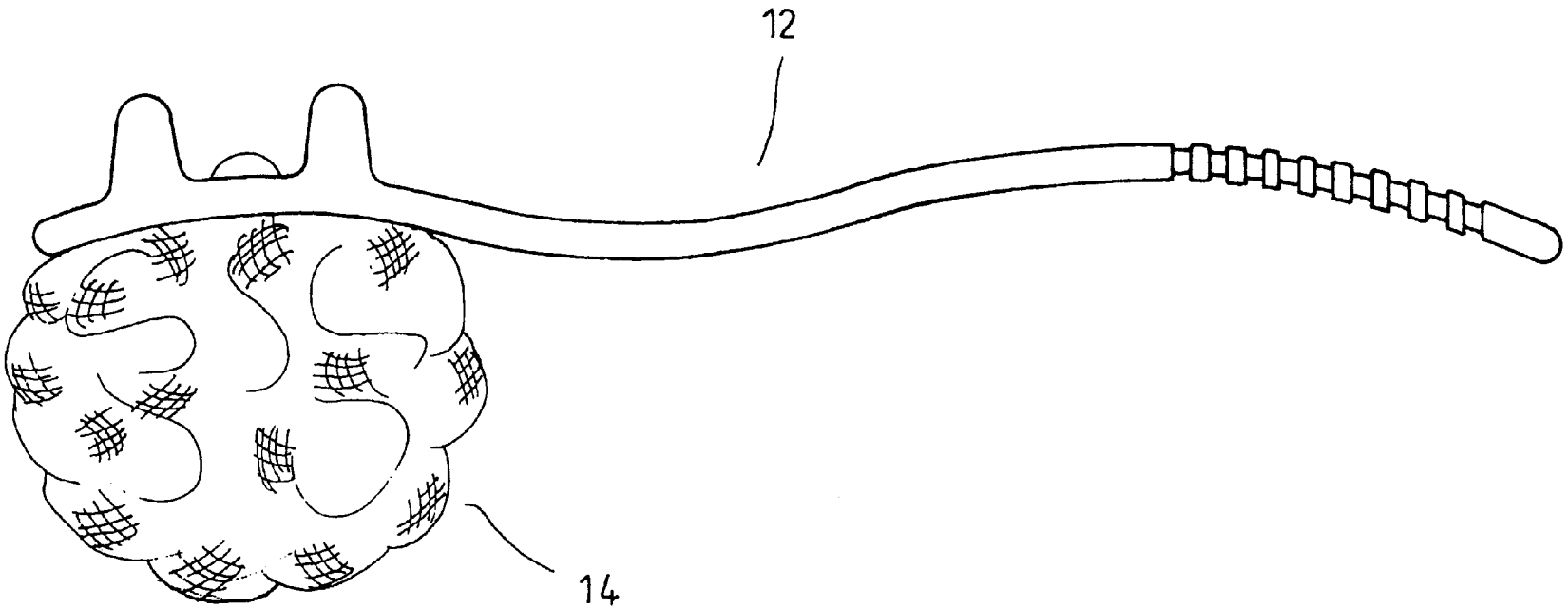
FIG. 3 is a side view of the preferred embodiment.
Figure 4:
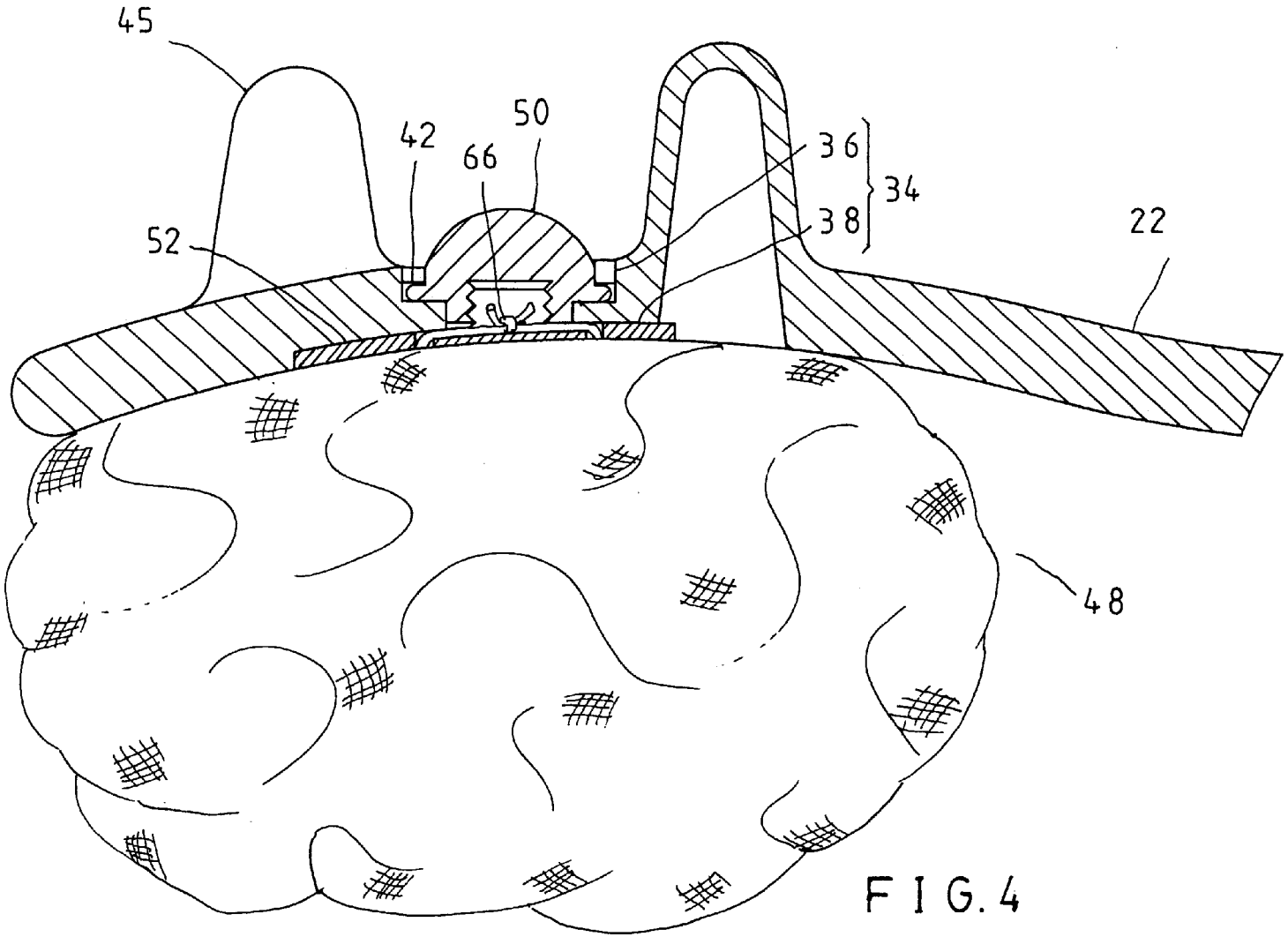
FIG. 4 is a sectional view of the preferred embodiment showing a securing seat coupled with a bathing ball.

With reference to FIGS. 1 to 4, a preferred embodiment of a bathing tool 10 of the present invention is shown to include a handle 12 and a cleaning brush unit 14.

The handle 12 has a rod member 22. The rod member 22 has a plate end 24, and a grip portion 26 having a plurality of grooves at the opposite end. A magnifying glass 28 is disposed in an opening 30 formed in the grip portion 26. The rod member has a middle portion provided with a generally pointed anti-slip portion 32. The plate end 24 is formed with a receiving hole 34. The receiving hole 34 has a first receiving chamber 36 and a second receiving chamber 38. The inner edge of the first receiving chamber 36 is provided with an engaging portion which includes a retaining groove 42 provided annularly in the inner edge of the first receiving chamber 36 and two insert notches 44 formed in the top side of the retaining groove 42. A plurality of massaging bosses 45 are integrally formed on and project from the opposite side of the plate end and are located near the first receiving chamber 36.

The cleaning brush unit 14 includes a securing seat 46 and a cleaning brush 48. The cleaning brush 48 is a bathing ball. The securing seat 46 includes a retaining block 50 and a connecting plate 52. The retaining block 50 has a base portion 54, two retaining portions 56 that are projecting blocks oppositely provided at the bottom edge of the base portion 54, a first connecting portion 58 that are screw holes provided in the bottom side of the base portion 54. The connecting plate 52 has a plate member 60, a second connecting portion 62 that is a threaded rod provided on one side of the plate member 60. The plate member 60 is provided with two holes 64 for passage of a string 66 to tie the cleaning brush 48 to the outer side of the plate member 60.

During assembly, the second connecting portion 62 is locked within the first connecting portion 58 such that the connecting plate 52 and the retaining block 50 can be securely coupled together. Then, the securing seat 46 is secured on the handle 12. The securing seat 46 has the two retaining portions 56 aligning with the two insert notches 44 of the engaging portion 40 and is inserted into the receiving hole 34. Next, the securing seat 46 is rotated a certain angle so that the retaining portions 56 are inserted into the retaining groove 42 to prevent the securing seat 46 from slipping from the handle 12.

In use, the user can hold the grip portion 26 of the handle 12 of the bathing tool 10, and use the cleaning brush 48 to clean his/her body. The magnifying glass 28 on the grip portion 26 is provided to enable users of elder age or of weak eyesight to look for tiny articles if desired. In addition, after brushing the body, the user can use the massaging bosses 45 to massage the body by stroking. If the user feels that holding the grip portion 26 to brush the body is strenuous, he/she can hold the handle 12 at the anti-slip portion 32 to shorten the distance between the cleaning brush 48 and the point of application of force. The generally pointed configuration of the anti-slip portion 32 can help prevent slippage of the handle 12 during use. Furthermore, the user can detach the cleaning brush unit 14 from the handle 12 and hold the securing seat 46 directly so as to rub the body with the cleaning brush 48.

Figure 5:
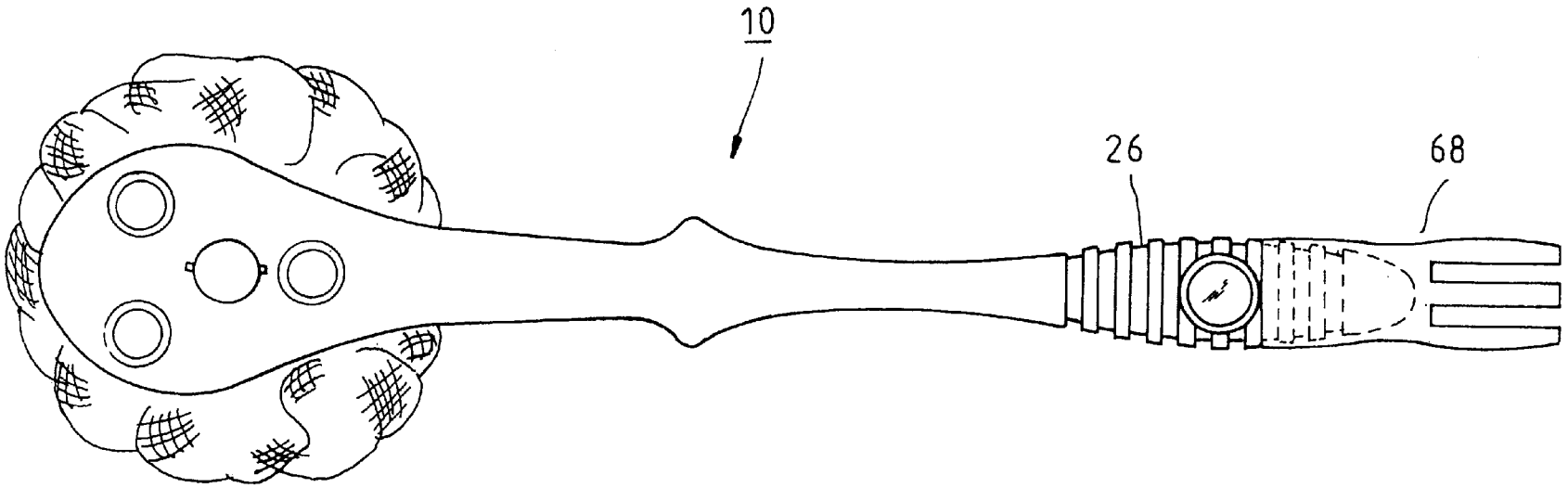
FIG. 5 is a schematic view of another preferred embodiment of the present invention.

Referring to FIG. 5, the bathing tool 10 of the present invention further includes a pawl 68 that is directly fitted on the grip portion 26 for scratching the user's body or removing thicker dirt. When not in use, the pawl 68 can be easily detached.

Figure 6:
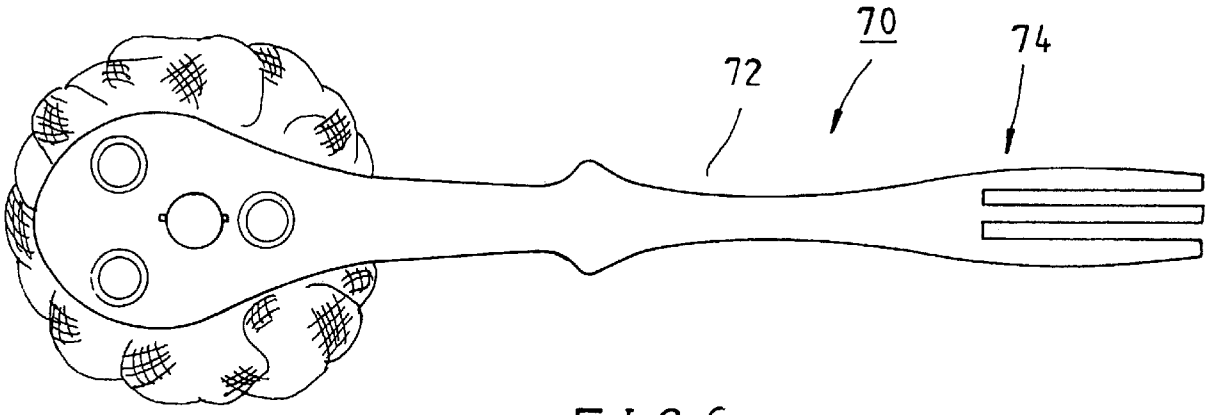
FIG. 6 is a schematic view of still another preferred embodiment of the present invention.

Referring to FIG. 6, a further preferred embodiment of a bathing tool 70 of the present invention is characterized in that the rear end of a handle 72 is configured to be a pawl 74.

Figure 7:
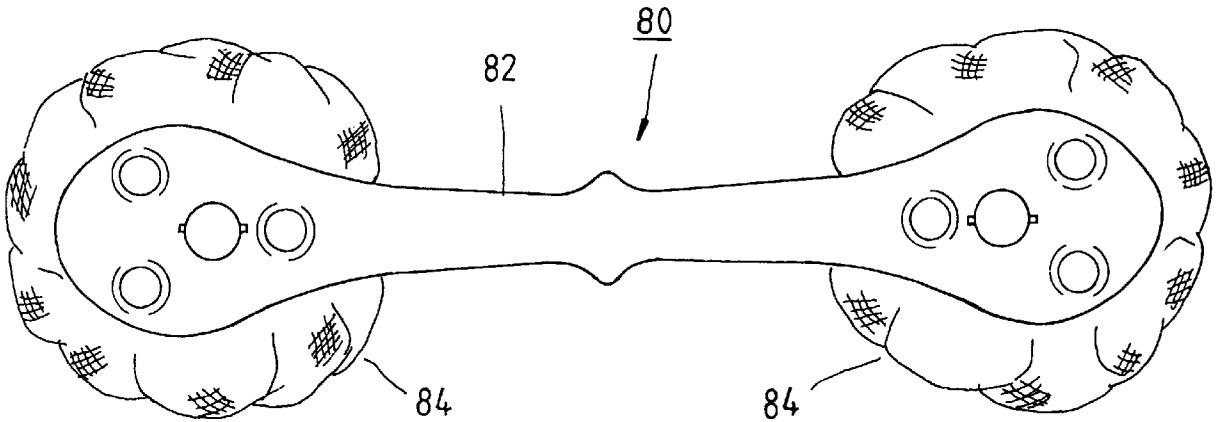
FIG. 7 is a schematic view of yet another preferred embodiment of the present invention.

Referring to FIG. 7, a further preferred embodiment of a bathing tool 80 of the present invention is characterized in that two ends of a handle 82 are provided with the above-described cleaning brush units 84.

In addition, the magnifying glass described in the first preferred embodiment of the bathing tool 10 can be substituted by a scrubbing stone for rubbing coarser skins.

Figure 8:
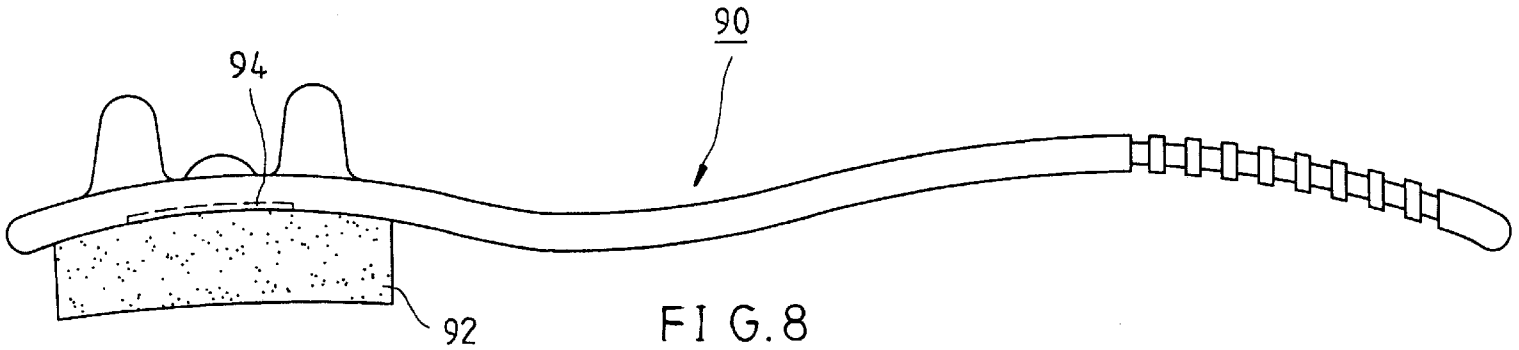
FIG. 8 is a schematic view of a further preferred embodiment of the present invention.
Figure 9:
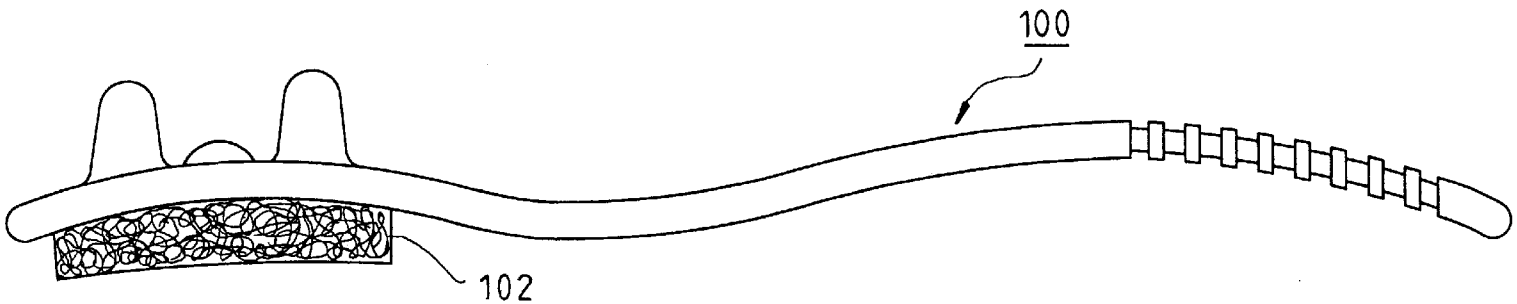
FIG. 9 is a schematic view of still another preferred embodiment of the present invention.
Figure 10:
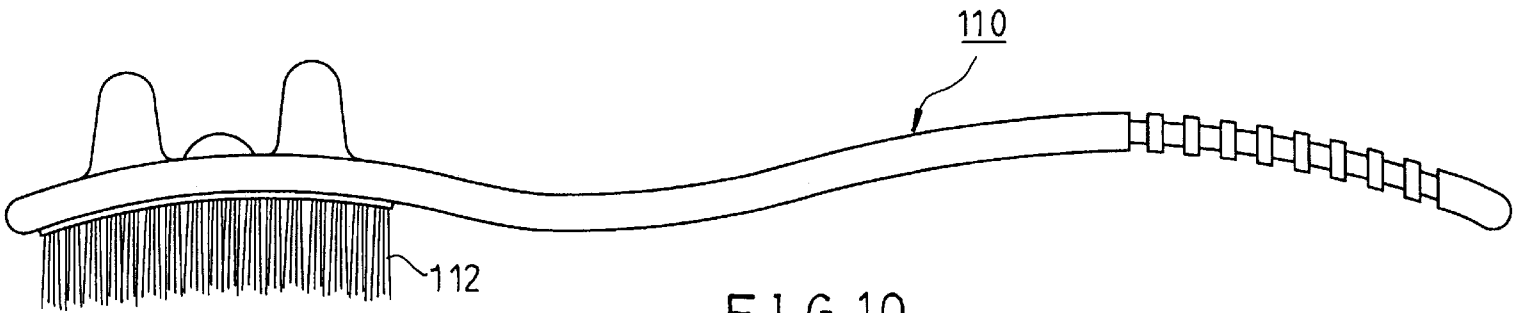
FIG. 10 is a schematic view of yet another preferred embodiment of the present invention.

Referring to FIGS. 8 to 10, which show three other preferred embodiments of bathing tools 90, 100, 110 of the present invention, respectively, the bathing tool 90 is characterized in that the cleaning brush 92 is a sponge adhered to the other side of a connecting plate 94. The cleaning brush 102 of the bathing tool 100 is a scrubbing cloth. The cleaning brush 112 of the bathing tool 110 is a bristle brush.

In sum, in the multifunctional bathing tool of the present invention, the cleaning brush can be firmly coupled with the handle and can be easily removed therefrom for independent use. Besides, the bathing tool of the present invention have multiple functions, such as massaging, magnifying, and scrubbing Although the present invention has been illustrated and described with reference to the preferred embodiment thereof, it should be understood that it is in no way limited to the details of such embodiment but is capable of numerous modifications within the scope of the appended claims.

What is claimed is:

1. A multifunctional bathing tool, comprising:

a handle having a rod member, at least one engaging portion provided at one end of said rod member, a plurality of massaging bosses provided on said rod member in a position opposite to said engaging portion;

at least one cleaning brush unit which includes a securing seat and a cleaning brush provided on said securing seat, said securing seat having a retaining portion for detachable engagement with said engaging portion so as to be coupled to said rod member, said cleaning brush and said massaging bosses being located on different sides of said rod member;

whereby the user can hold said handle to clean his/her body with said cleaning brush, said massaging bosses being used to massage the body, said cleaning brush unit being detachable from said handle so that the user can hold said securing seat directly to clean the body.

2. The multifunctional bathing tool of claim 1, wherein said rod member has a plate end, a receiving hole formed in said plate end, said engaging portion being provided at an inner edge of said receiving hole, said securing seat including a retaining block and a connecting plate disposed on one side of said retaining block, said retaining portion being provided on said retaining block, said retaining block being coupled to said engaging portion by means of said retaining portion so as to be secured in said receiving hole, said cleaning brush being secured to an outer side of said connecting plate.

3. The multifunctional bathing tool of claim 2, wherein said retaining block is provided with a first connecting portion, said connecting plate being provided with a second connecting portion, said connecting plate being secured to the outer side of said retaining block by means of said second connecting portion which is coupled to said first connecting portion of said retaining block.

4. The multifunctional bathing tool of claim 3, wherein said first connecting portion is a threaded rod, said second connecting portion is a threaded hole.

5. The multifunctional bathing tool of claim 2, wherein said engaging portion includes a retaining groove, and two insert notches oppositely formed in a top side of said retaining groove, said retaining portion being a protrusion projecting from a side edge of said projecting block.

6. The multifunctional bathing tool of claim 2, wherein said cleaning brush is tied to the outer side of said connecting plate.

7. The multifunctional bathing tool of claim 6, wherein said cleaning brush is a bathing ball.

8. The multifunctional bathing tool of claim 2, wherein said cleaning brush is adhered to the outer side of said connecting plate.

9. The multifunctional bathing tool of claim 8, wherein said cleaning brush is a sponge.

10. The multifunctional bathing tool of claim 8, wherein said cleaning brush is a scrubbing cloth.

11. The multifunctional bathing tool of claim 8, wherein said cleaning brush is a bristle brush.

12. The multifunctional bathing tool of claim 1, wherein said rod member has two ends respectively provided with said engaging portion and said massaging bosses, each of said engaging portions being provided with said cleaning brush unit.

13. The multifunctional bathing tool of claim 1, wherein said rod member is provided with a grip portion at the other end.

14. The multifunctional bathing tool of claim 1, wherein the other end of said rod member is provided with a magnifying glass.

15. The multifunctional bathing tool of claim 1, wherein a scrubbing stone is provided at the other end of said rod member.

16. The multifunctional bathing tool of claim 1, wherein a pawl is provided at the other end of said rod member.

17. The multifunctional bathing tool of claim 1, wherein said rod member is provided with an anti-slip portion thereon.

* * * * *